US008121333B2

(12) United States Patent
Woolf et al.

(10) Patent No.: US 8,121,333 B2
(45) Date of Patent: Feb. 21, 2012

(54) SUSPENSION DEVICE FOR MICROPHONE

(75) Inventors: Christopher Woolf, Cornwall (GB); Timothy George Henson, West Midlands (GB)

(73) Assignee: Rycote Microphone Windshields Ltd., Gloucestershire (GB)

( * ) Notice: Subject to any disclaimer, the term of this patent is extended or adjusted under 35 U.S.C. 154(b) by 869 days.

(21) Appl. No.: 12/161,943

(22) PCT Filed: Jan. 22, 2007

(86) PCT No.: PCT/GB2007/000192

§ 371 (c)(1), (2), (4) Date: Jul. 23, 2008

(87) PCT Pub. No.: WO2007/085805

PCT Pub. Date: Aug. 2, 2007

(65) Prior Publication Data

US 2009/0016558 A1 Jan. 15, 2009

(30) Foreign Application Priority Data

Jan. 24, 2006 (GB) ..... 0601338.7

(51) Int. Cl.
*H04R 9/08* (2006.01)

(52) U.S. Cl. ..... 381/368; 381/361

(58) Field of Classification Search ..... 381/361, 381/362, 363, 365, 366, 368, 169, 188, 364
See application file for complete search history.

(56) References Cited

U.S. PATENT DOCUMENTS

| | | | | |
|---|---|---|---|---|
| 4,040,547 | A | 8/1977 | Dickey | |
| 4,194,096 | A | 3/1980 | Ramsey | |
| 4,396,807 | A | 8/1983 | Brewer | |
| 4,546,950 | A * | 10/1985 | Cech | 248/610 |
| 6,386,377 | B1 | 5/2002 | Yeoman | |
| 2003/0197316 | A1 | 10/2003 | Baumhauer, Jr. et al. | |
| 2006/0227991 | A1 | 10/2006 | Klemme | |

FOREIGN PATENT DOCUMENTS

| | | | |
|---|---|---|---|
| DE | 29806357 | | 8/1998 |
| GB | 2085263 | A | 4/1982 |
| JP | 2001157102 | A | 6/2001 |
| WO | 2007051925 | A1 | 10/2007 |

OTHER PUBLICATIONS

International Search Report of PCT/GB2007/000192.
Search Report of Application No. GB0601338.7.

* cited by examiner

*Primary Examiner* — Thomas L Dickey
*Assistant Examiner* — Fazli Erdem
(74) *Attorney, Agent, or Firm* — Sutherland Asbill & Brennan LLP

(57) ABSTRACT

The present invention is a suspension device comprising a frame and a means for holding a microphone. The means for holding a microphone is secured to the frame by two arms lying in a plane and the arms are shaped to allow movement of the means for holding a microphone in a direction transverse to the plane.

14 Claims, 3 Drawing Sheets

SUSPENSION DEVICE FOR MICROPHONE

The present invention relates to suspension devices for use in sound systems, the suspension devices are particularly for use with microphones.

It is well known that sound is transmitted as tiny changes in air pressure and microphones operate by sensing these changes and converting them into an electrical signal. In considering the way in which the microphone works it is assumed that the changes in pressure due to the original sound source are the only forces that the microphone senses. It is also assumed that the microphone body is truly static. In fact this is rarely the case and every effort must therefore be made to reduce the effect of external influences such as movement of the microphone, which may produce an electrical signal within the microphone that is unrelated to pressure changes due to the original sound source.

The present invention is concerned particularly with the reduction of the impact of movement of the microphone and the consequent generation of spurious electrical noise signals within the microphone.

Microphones include an elastically suspended diaphragm that moves within the microphone body with changes in air pressure or in response to air pressure gradients to create an electrical signal. As set out above, it is assumed that the microphone body is static and that the diaphragm moves only in response to such variations in pressure or pressure gradients. However it is not unusual for the microphone body to move, for example if it is knocked. When the microphone is moved the diaphragm initially attempts to remain in the static rest position owing to its own finite mass and that of the air around it. However the elastic forces that tension the diaphragm will quickly restore the position of the diaphragm relative to the microphone body, which causes movement of the diaphragm identical to that caused by the sensing of a sound source and therefore produces an electrical signal as if a sound had been sensed. This gives rise to noise generated by the microphone and known as "handling noise".

It is known in the microphone industry to mount the, or part of the, microphone in some form of suspension that attempts to isolate it, across a broad frequency spectrum, from external forces that could give rise to movement. However there are problems with existing suspension devices.

The present invention relates to a suspension device comprising a frame and a means for holding a microphone, wherein the means for holding a microphone is secured to the frame by two arms lying in a plane and wherein the arms are shaped to allow movement of the means for holding a microphone in a direction transverse to the plane.

The plane of the two arms is preferably adapted in use to be parallel or co-planar with the diaphragm of the microphone being held.

Preferably the movement of the means for holding a microphone is generally orthogonal to the plane.

Whilst it is possible to use a single suspension device, two or more of the suspension device of the present invention will frequently be used together. The suspension devices will, in use, be spaced along the length of a microphone body and will preferably be positioned with the planes, in which the arms of each device lie, parallel to each other.

The use of two arms can provide advantages over existing flat plane suspension devices, which include entire, pierced or cut away elastic diaphragms, or similar designs that can be resolved geometrically into a uniplanar structure. This is because the means for holding a microphone may need to expand and contract depending on the size of the microphone and the use of two arms allows this expansion and contraction without deformation orthogonal to the plane as the arms just move away from or towards each other. With existing flat plane suspension devices the expansion or contraction of the means for holding a microphone often causes permanent, as opposed to momentary, deformation out of the static plane position, a lack of stability and uncontrolled or erratic movement of the suspension device itself and of the microphone.

In addition, the presence of two arms allows each arm to have a long path length between the frame and the means to hold a microphone. This long path length allows substantial movement of the means to hold a microphone in a direction transverse to the plane in which the arms lie but minimises movement within that plane.

Each of the arms is preferably non-linear in shape, for example each arm may be curved in any suitable way, such as recurved or double recurved. The most preferred overall shape of the arms is lyre, or recurved phorminx, shaped.

The use of non-linear arms ensures that the arms have as great a length as possible compared to their thickness to allow them to behave elastically and allow movement transverse, preferably orthogonal, to the plane. The shape of the arms also permits, but to a more limited extent, movement of the means to hold a microphone in a direction within or parallel to the plane, which is beneficial.

The arms are preferably mirror images of each other in terms of shape and most preferably also in terms of position relative to the frame and the means to hold a microphone. Preferably the device as a whole has an axis of symmetry.

The arms are preferably made from a material that is deformable. The material may be a resiliently deformable material. The material may be a suitable plastics material, a suitable metal or a suitable fibrous material.

The frame may be any suitable shape depending on the desired end use of the device. For example the frame may be circular or square or may simply comprise a linear base.

The means for holding a microphone may be any suitable means. The means for holding a microphone may be a circular component, with or without keying, that is matched to the microphone. Alternatively the means may comprise a set of expandable jaws between which a microphone can be placed.

Two or more of the arms, the frame and the means for holding a microphone are preferably formed integrally with each other. Most preferably all three aforementioned components are formed integrally with each other to provide a one-piece suspension device.

The provision of a one-piece suspension device is advantageous in terms of manufacture and use. The device of the present invention can be stamped or moulded in a single action compared to existing prior art suspension devices that require the provision of a frame and a means for holding a microphone as separate components together with one or more elastic elements used to connect the components together. The device of the present invention is easier to use as it does not need to be assembled before use as with the above described existing suspension clamp that must have the means for holding a microphone secured to the frame by the separate elastic elements before use.

A number of embodiments of the invention will now be described in further detail with reference to the drawings in which.

Figure 1:
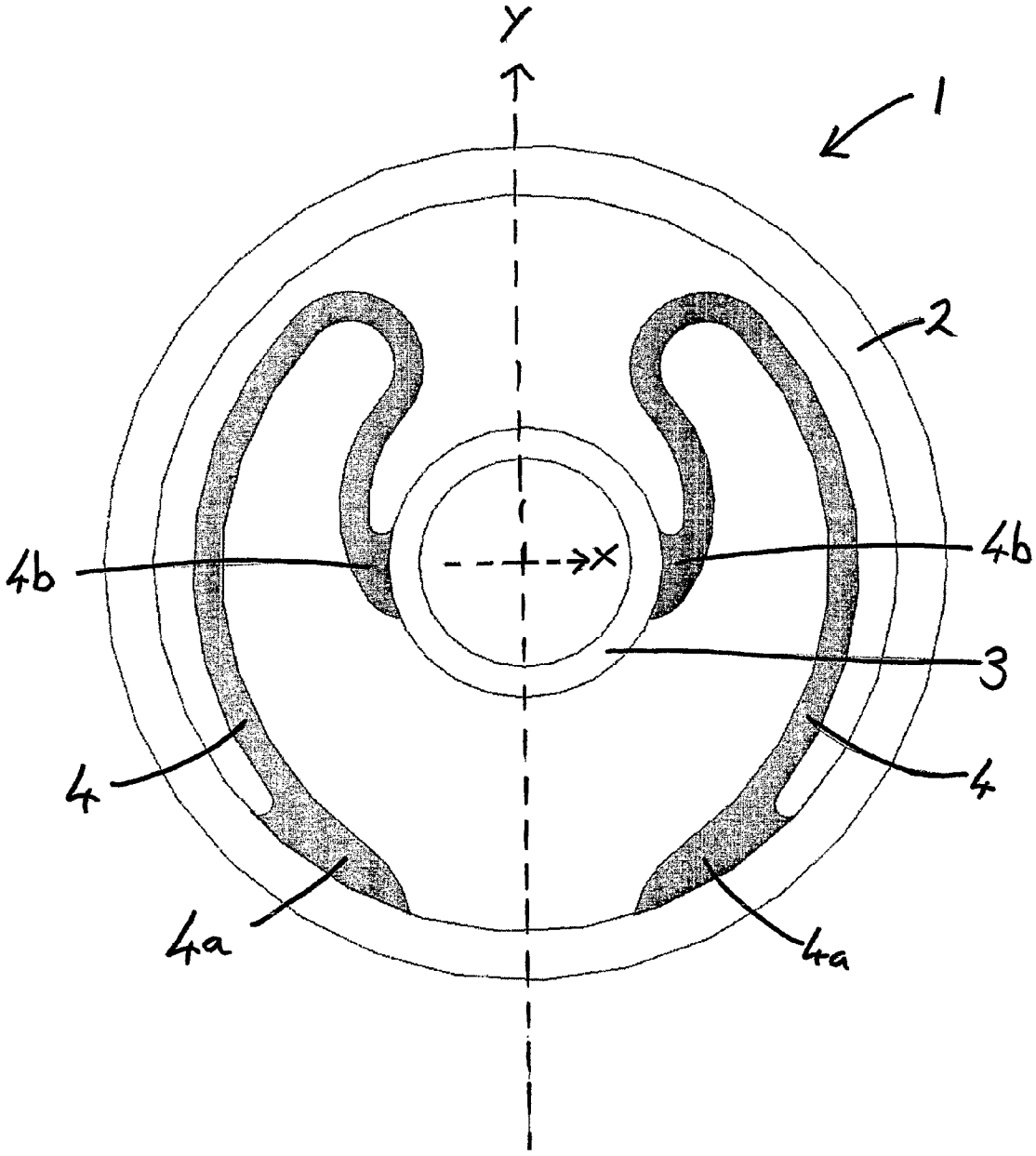
FIG. 1 shows a suspension device according to a first embodiment of the invention.

FIG. 1 shows a first embodiment of a suspension device 1 of the present invention. The suspension device 1 comprises a frame 2, a means 3 for holding a microphone and two arms 4 securing the means 3 to the frame 2.

The frame 2 is circular in shape. The means 3 for holding a microphone is also circular in shape, and in this embodiment the size of the means 3 is chosen to match the particular microphone the device is to suspend.

When the suspension device is not in use the means 3 for holding a microphone is centred within the frame 2.

The arms 4 extend between the frame 2 and the means for holding a microphone 3 and suspend said means 3 within the frame 2. Each arm 4 is recurved in shape. Each arm 4 has a first end 4*a* secured to the frame 2 and a second end 4*b* secured to the means 3 for holding a microphone. In this example the arms lie in a plane defined by the x and y axes.

The device 1 has a line of symmetry running between the two arms 4 and through the means 3 for holding a microphone and defined by the y axis.

Figure 2:
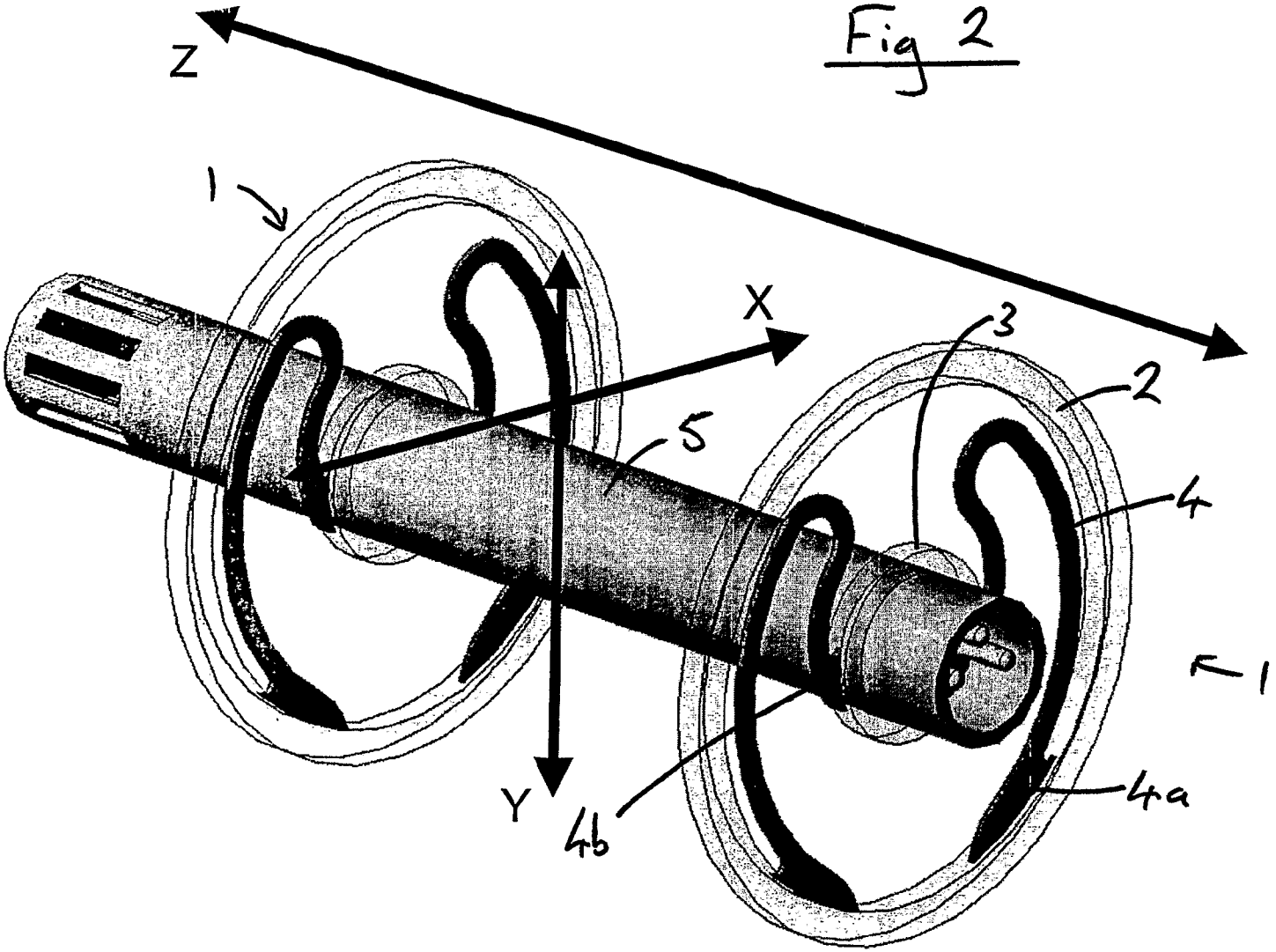
FIG. 2 shows two of the suspension devices of FIG. 1 in use with an axial or "end fire" microphone.

When in use, seen most clearly in FIG. 2, the ends 4*a* of the arms 4 are secured to the frame 2, close to the lowest part of the frame 2 and spaced slightly apart from each other. The ends 4*b* are secured to the means 3 for holding a microphone at positions opposed to each other.

Overall a shape which is generally lyre shaped is formed by the arms 4.

In FIG. 2, where appropriate, the same reference numerals are used as in FIG. 1 to show the same part. In use more than one suspension device 1 will generally be used to suspend a microphone. It can be seen from FIG. 2 that two suspension devices are used to support the microphone 5 shown.

Each end of the microphone 5 is inserted into the means 3 for holding a microphone of one of the two suspension devices. The arms 4 allow significant excursion of the microphone 5 along an axis transverse, preferably orthogonal, to the x-y plane, as can be seen by the reference to the z axis in FIG. 2, but more restricted excursions of the microphone within the x-y plane.

In this embodiment the frames 2 are fixed relative to each other and are also fixed directly or indirectly to a support structure such as camera, or an attachment for a camera.

Figure 3:
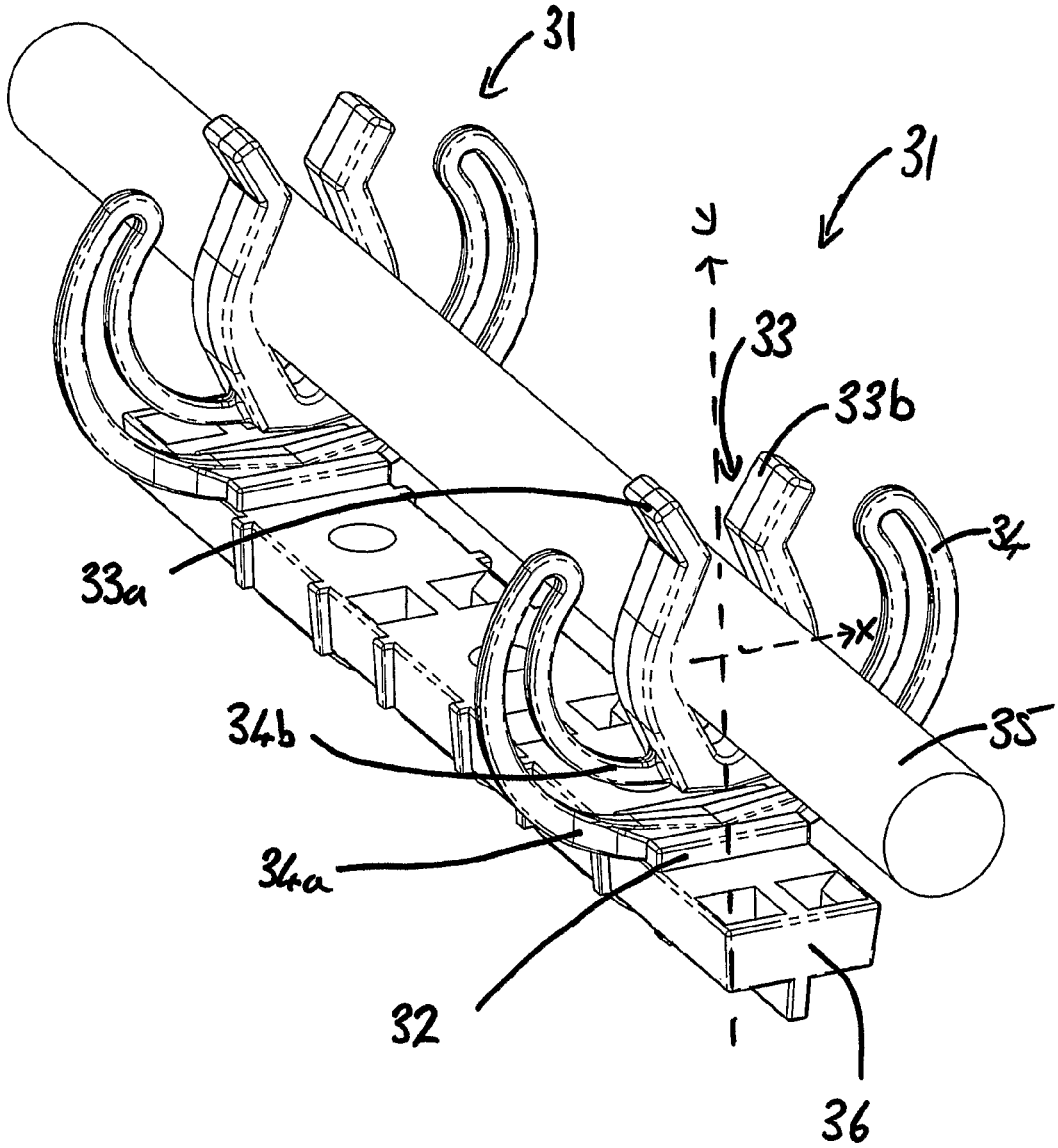
FIG. 3 shows two suspension devices according to a second embodiment of the invention in use with an axial or "end fire" microphone.

FIG. 3 shows a second embodiment of a suspension device according to the present invention. The suspension device 31 comprises a frame 32, a means 33 for holding a microphone and two arms 34 securing the means 33 to the frame 32.

The frame 32 is a truncated platform which can be mounted on a bar 36 which is in turn, directly or indirectly, secured to a handle (not shown) or mounting means (not shown). The means 33 for holding a microphone is suspended above the centre of the frame 32 by the arms 34.

The means 33 comprises a set of resilient jaws 33*a* and 33*b* between which a microphone 35 can be held.

The arms 34 extend between the frame 32 and the means for holding a microphone 33 and suspend said means 33 over the frame 32. Each arm is recurved in shape. Each arm has a first end 34*a* secured to the frame 32 and a second end 34*b* secured to the means 33 for holding a microphone. In this example the arms lie in a plane defined by the x and y axes.

The device 31 has a line of symmetry running between the two arms 34 through the means 33 for holding a microphone and defined by the y axis.

When in use in the embodiment shown the ends 34*a* of the arms 34 are secured to the frame 32, at either end of the frame and spaced slightly apart from each other. The ends 34*b* are each secured to one part of the set of jaws forming means 33 for holding a microphone at positions opposed to each other.

Overall a shape which is generally lyre shaped is formed by the arms 34.

In use more than one suspension device 31 will generally be used to suspend a microphone. It can be seen from FIG. 3 that two suspension devices 31 are used to support the microphone 35 shown.

Each end of the microphone 35 is inserted between the jaws 33*a*, 33*b* of the means 33 for holding a microphone of one of the two suspension devices. The arms 34 allow significant excursion of the microphone 35 along an axis transverse, preferably orthogonal, to the x-y plane, but more restricted excursions of the microphone within the x-y plane.

The invention claimed is:

1. A suspension device comprising a frame and a microphone holder, wherein the microphone holder comprises and is secured to the frame by two arms at least substantially lying in a plane, and wherein the arms are shaped to allow movement of the microphone holder in a direction transverse to the plane, wherein each arm is recurved in shape, so that said arm curves in a first direction before then turning substantially back on itself in substantially an opposite direction.

2. A suspension device according to claim 1, wherein the plane of the two arms is at least one of parallel and co-planar with a diaphragm of a microphone to be held by the suspension device.

3. A suspension device according to claim 1, wherein the movement of the microphone holder is generally orthogonal to the plane.

4. A suspension device according to claim 1, wherein each of the arms is non-linear in shape.

5. A suspension device according to claim 1, wherein each arm is double recurved in shape.

6. A suspension device according to claim 1, wherein the overall shape of the arms is at least one of lyre and recurved phorminx shaped.

7. A suspension device according to claim 1, wherein the arms are mirror images of each other in terms of shape.

8. A suspension device according claim 1, wherein the arms are mirror images of each other in terms of position relative to the frame and the microphone holder.

9. A suspension device according to claim 1, wherein the device as a whole has an axis of symmetry.

10. A suspension device according to claim 1, wherein the arms are made from a material that is deformable.

11. A suspension device according to claim 10, in which the material is resiliently deformable.

12. A suspension device according to claim 1, wherein the microphone holder comprises a set of expandable jaws between which a microphone can be placed.

13. A suspension device according to claim 1, wherein all three of the arms, the frame and the microphone holder are formed integrally with each other to provide a one-piece suspension device.

14. A combination of at least two suspension devices each comprising a frame and a microphone holder, wherein the microphone holder comprises and is secured to the frame by two arms at least substantially lying in a plane, and wherein the arms are shaped to allow movement of the microphone holder in a direction transverse to the plane, wherein each arm is recurved in shape so that said arm curves in a first direction before then turning substantially back on itself in substantially an opposite direction, wherein the suspension devices are spaced along the length of a microphone body and arc positioned with the planes in which the arms of each device lie parallel to each other.

* * * * *